US006030061A

United States Patent [19]

Lee

[11] Patent Number: 6,030,061

[45] Date of Patent: Feb. 29, 2000

[54] COMBINATION COOKBOOK HOLDER AND RECIPE FILE

[75] Inventor: Stuart Harvey Lee, New York, N.Y.

[73] Assignee: M. Kamenstein, Inc., Elmsford, N.Y.

[21] Appl. No.: 09/178,265

[22] Filed: Oct. 23, 1998

[51] Int. Cl.[7] ..... A47B 45/00

[52] U.S. Cl. ..... 312/205; 312/281; 211/43

[58] Field of Search ..... 312/205, 348.5, 312/183, 282, 281; 211/43

[56] References Cited

U.S. PATENT DOCUMENTS

| | | | |
|---|---|---|---|
| 2,545,844 | 3/1951 | Cougias | 211/43 |
| 4,102,275 | 7/1978 | Spound et al. | 312/205 |
| 5,865,517 | 2/1999 | Wang | 312/205 |

FOREIGN PATENT DOCUMENTS

| | | | |
|---|---|---|---|
| 2620438 | 2/1978 | Germany | 312/301 |
| 463170 | 3/1937 | United Kingdom | 312/205 |

*Primary Examiner*—Peter M. Cuomo
*Assistant Examiner*—Gerald Anderson
*Attorney, Agent, or Firm*—Robert A. Koons, Jr.; James W. Bolcsak; Pepper Hamilton LLP

[57] ABSTRACT

A combination article for use as a kitchen organizer for holding and organizing both cookbooks and recipes on file cards, comprising an expandable bookholder portion and adapted for selectively accessing the recipes and cookbooks from either of two sides of the organizer is disclosed.

1 Claim, 14 Drawing Sheets

COMBINATION COOKBOOK HOLDER AND RECIPE FILE

BACKGROUND OF THE INVENTION

1. Field of the Invention

The invention relates to recipe holders. More specifically, the invention relates to a combination cookbook holder and recipe file, comprising an adjustable means for holding cookbooks upright for storage, in combination with drawers for storing recipes on cards.

2. Description of the Related Art

There has long been a need for articles for use in reducing clutter in and organizing kitchens. Most household kitchens accumulate a large number of recipes which need to be kept organized for easy access and retrieval.

Boxes are available to serve as storage containers for recipes on file cards, where the boxes are made from metal, plastic or wood, sized to hold standard size file cards. Book ends are available in a wide range of sizes and styles to hold books in an upright position for storage. There has been a long felt need however for a combination recipe storage article which can be used to store both recipes on cards and to store cookbooks in a kitchen.

OBJECTS OF THE INVENTION

Accordingly, it is an object of the invention to provide an article for convenient storage for cookbooks in combination with convenient storage for cards such as those used for recording and storing recipes.

It is yet another object of the invention to provide an improved storage article for cookbooks and recipe cards which can be used in either of two orientations according to the choice of the user: a first orientation having cookbooks arranged to the left of a recipe file card storage section, and a second orientation having cookbooks arranged to the right of a recipe file card storage section.

It is another object of the invention to provide an improved storage article for cookbooks and recipe cards which can be used on island cabinet units in a kitchen, with recipe file cards accessible from either of two opposed sides of the storage article.

Other objects will become apparent from the description of the invention which follows. The article which is disclosed here satisfies all of the objects recited and may also be used to satisfy other storage needs in a household, such as holding books other than cookbooks and files other than recipes.

SUMMARY OF THE INVENTION

Briefly, the invention is a combination storage article used for reducing clutter in and for organizing a kitchen. The storage article combines the ability to store recipes bound in books with the ability to store recipes on index cards or on other pieces of paper or cardstock. The storage article of the invention provides two storage portions in combination. The structure of the storage article according to the present invention may be understood by the following description and by reference to the accompanying drawings. A first portion of the storage article comprises a cabinet adapted to hold two drawers, with one drawer disposed above the other drawer. This first portion of the storage article comprises a first and a second generally vertical side wall. The first side wall is also used as one element of the second portion of the storage article, which second portion is used as an extendable holder for cookbooks.

DETAILED DESCRIPTION OF THE INVENTION

Figure 1:
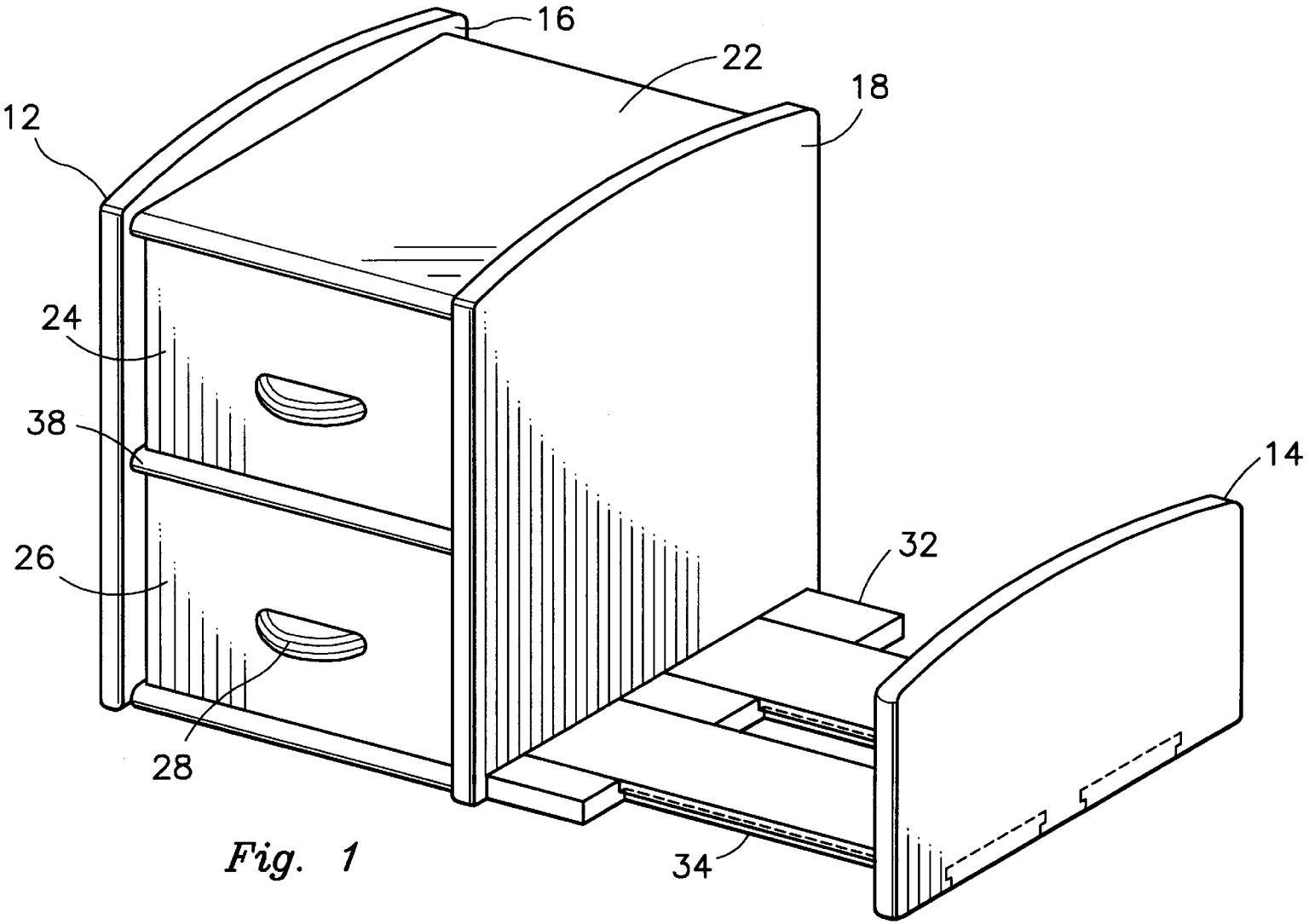
FIG. 1 illustrates a perspective view of a first embodiment of a combination storage article in accordance with the invention.
Figure 2:
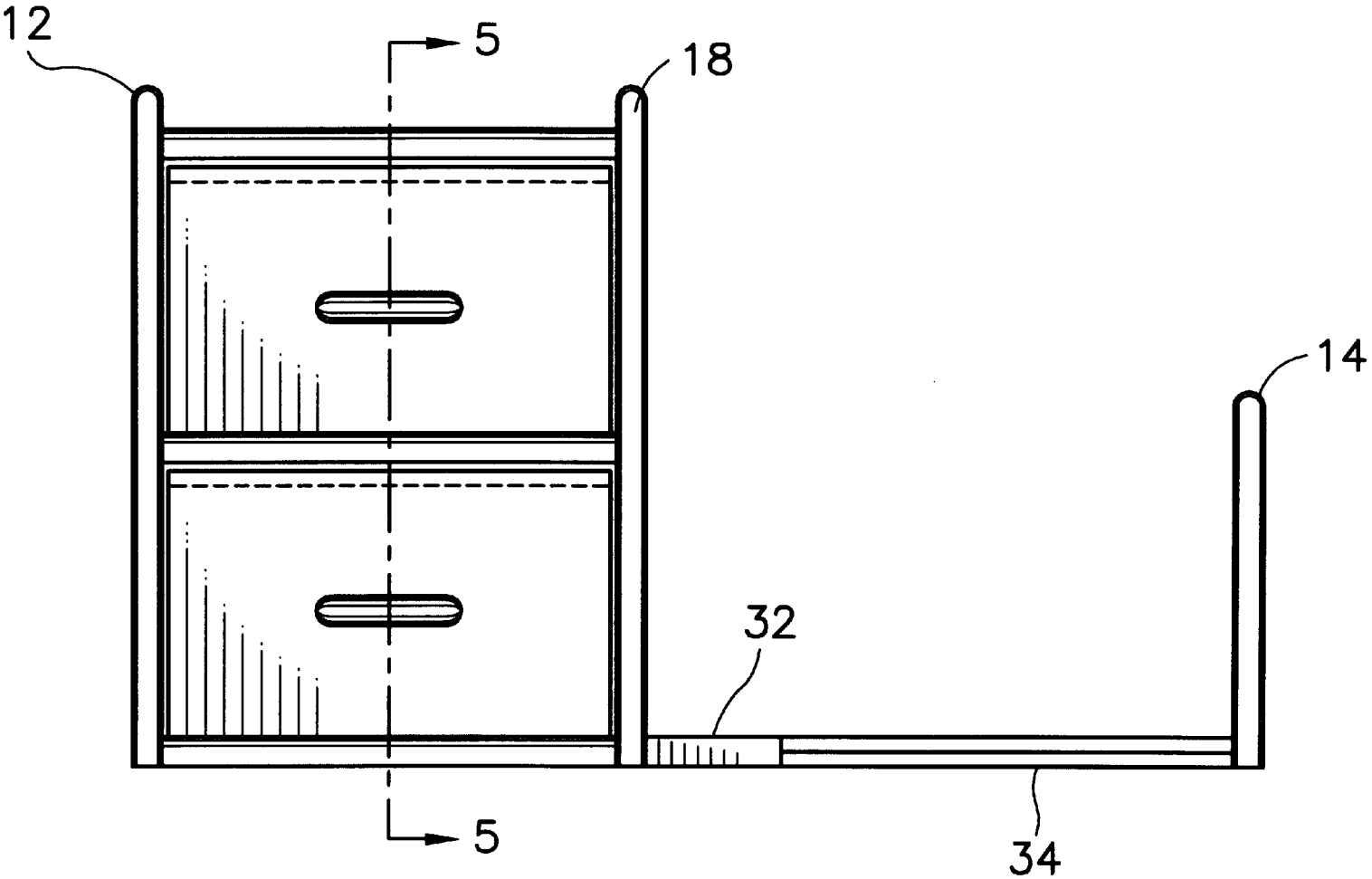
FIG. 2 illustrates a front elevation view of the storage article of FIG. 1, with the extendable book holder portion in an extended position.
Figure 3:
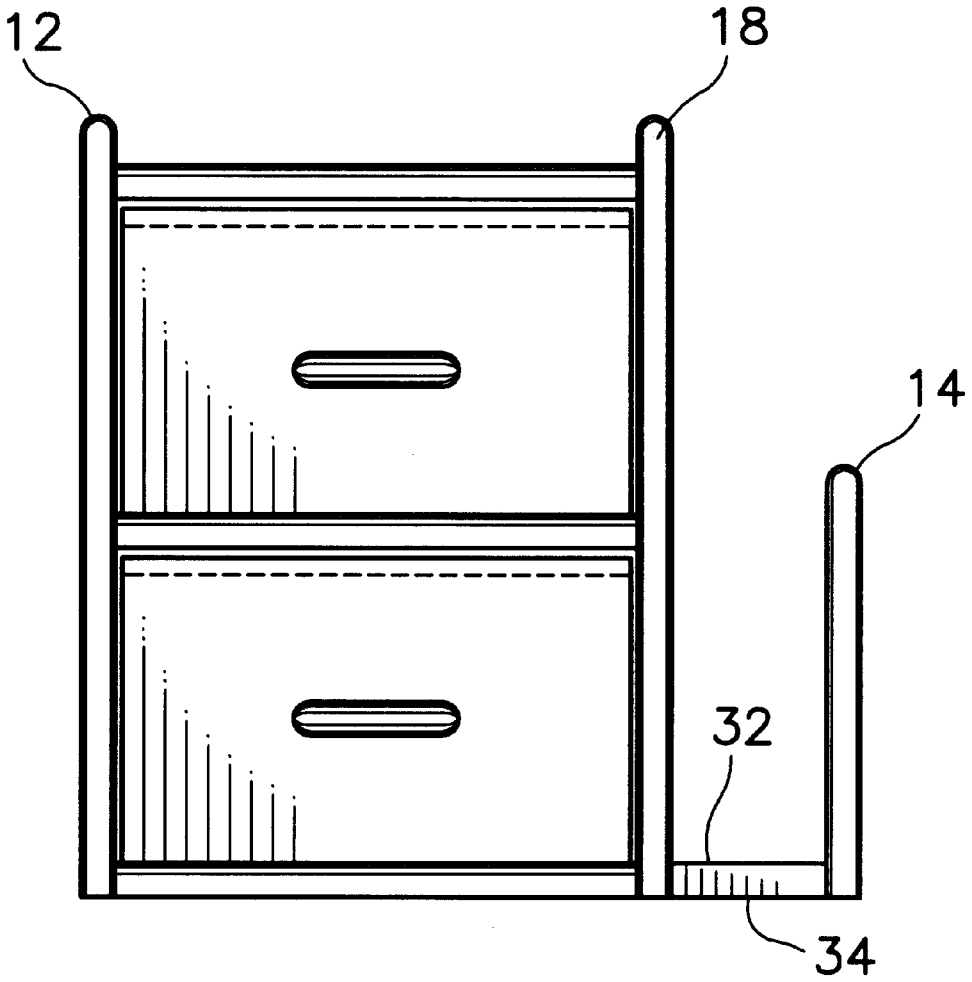
FIG. 3 illustrates a front elevation view of the storage article of FIG. 1, with the extendable book holder portion in a retracted position.
Figure 4:
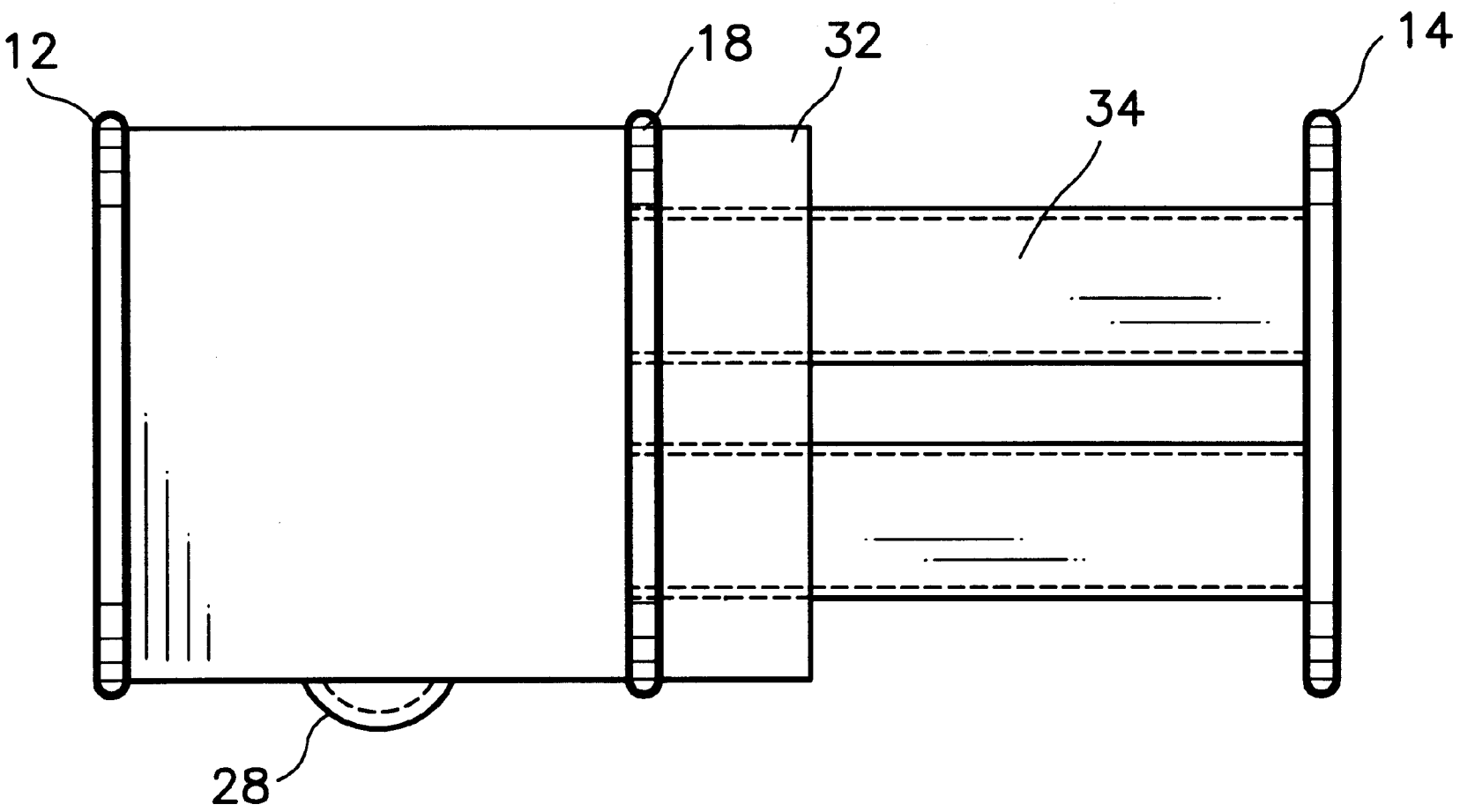
FIG. 4 illustrates a top plan view of the storage article of FIG. 2, with the book holder in an extended position.
Figure 5:
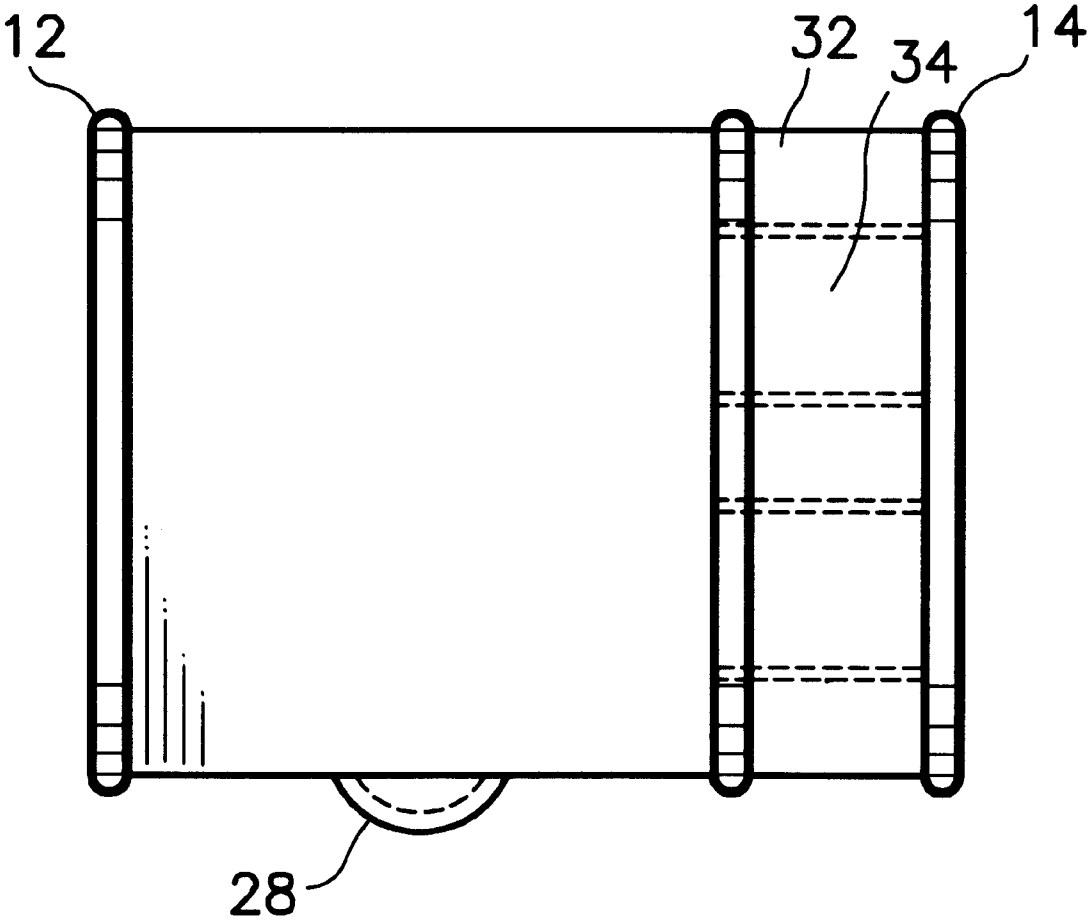
FIG. 5 illustrates a top plan view of the storage article of FIG. 3, with the book holder in a retracted position.
Figure 6:
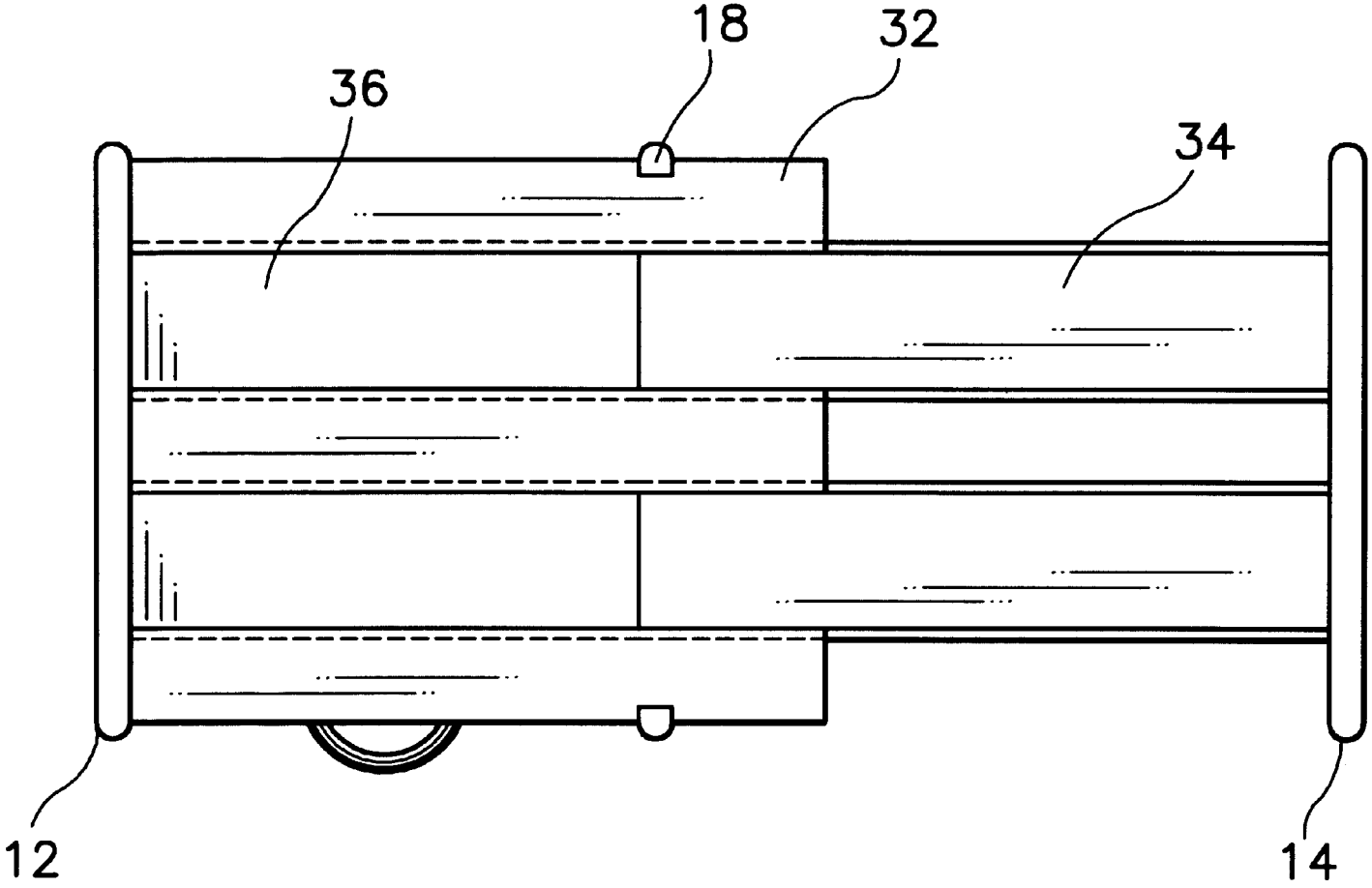
FIG. 6 illustrates a bottom plan view of the storage article of FIG. 2.
Figure 7:
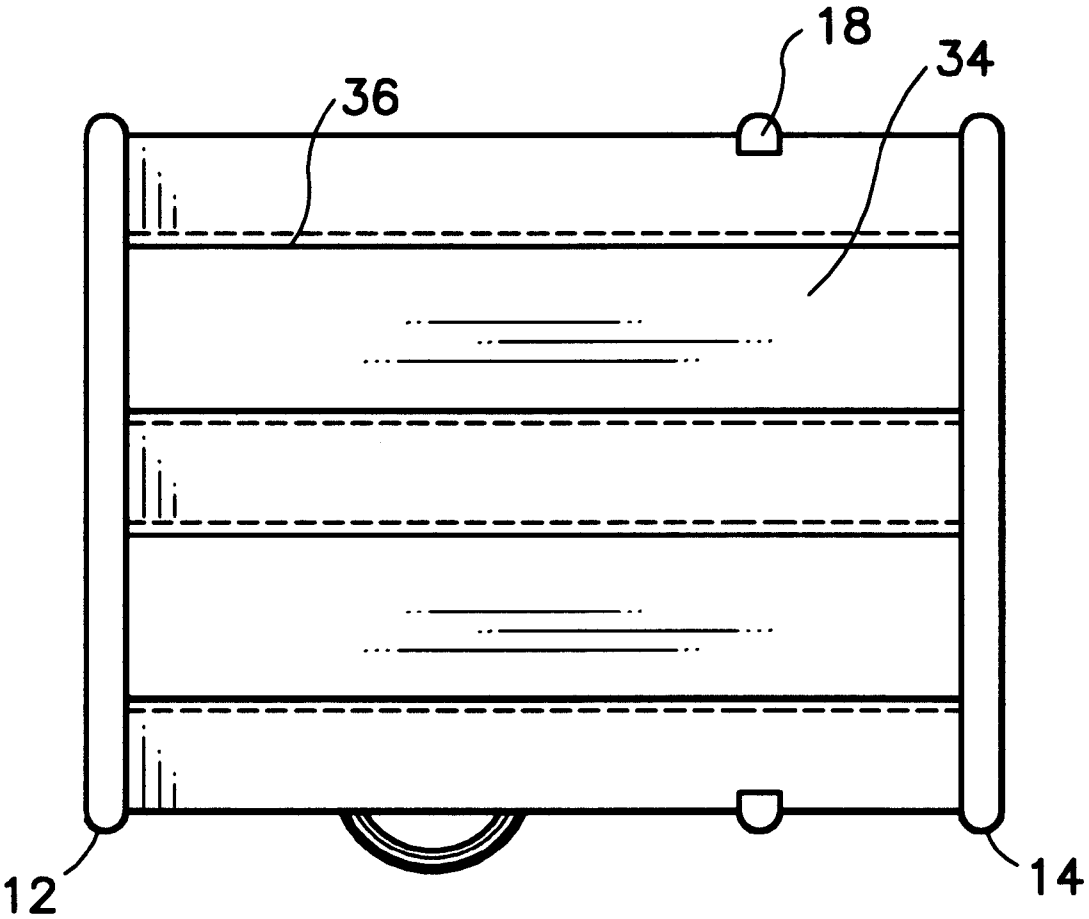
FIG. 7 illustrates a bottom plan view of the storage article of FIG. 3.
Figure 8:
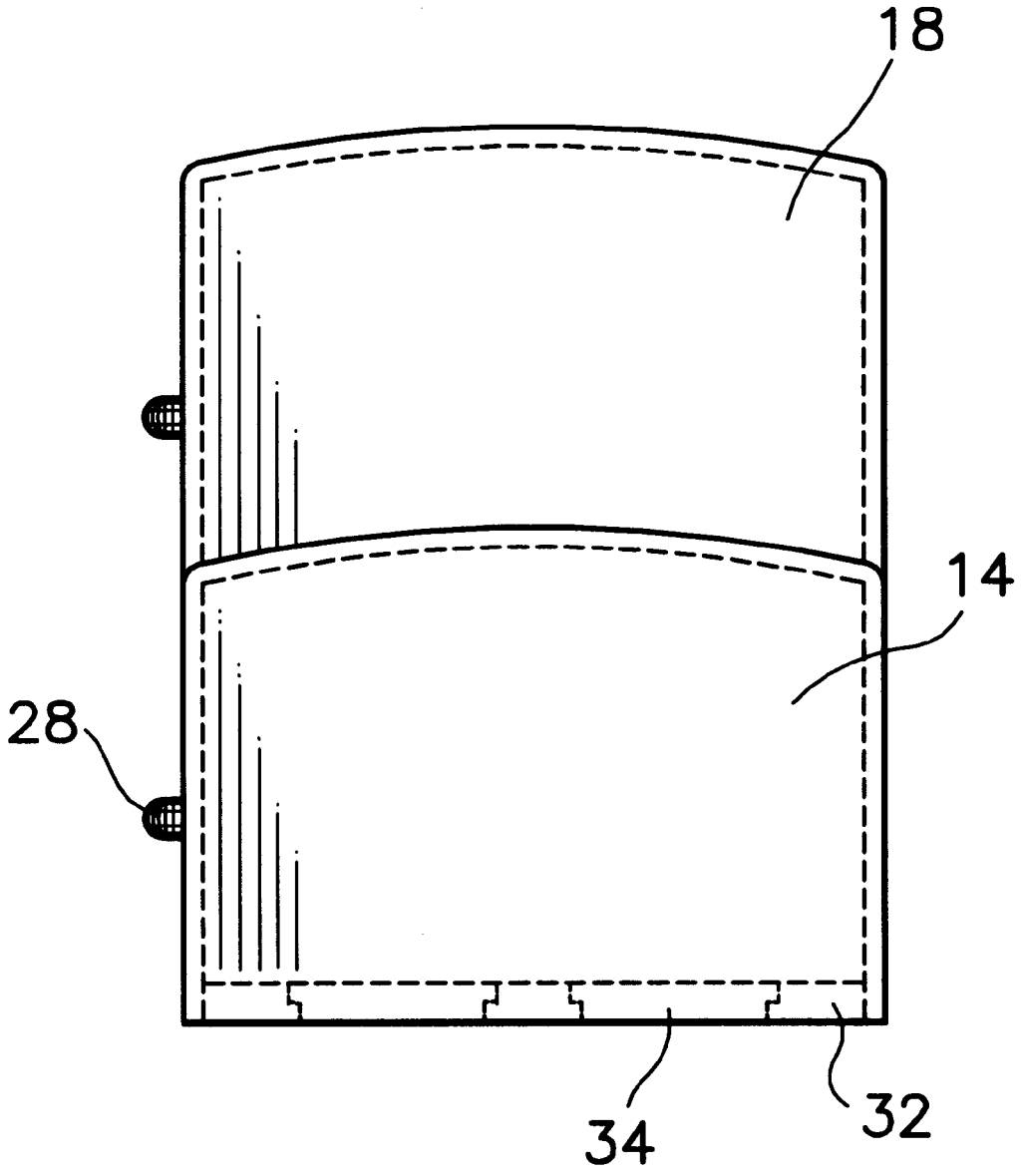
FIG. 8 illustrates a right elevation view of the storage article of FIG. 1.
Figure 9:
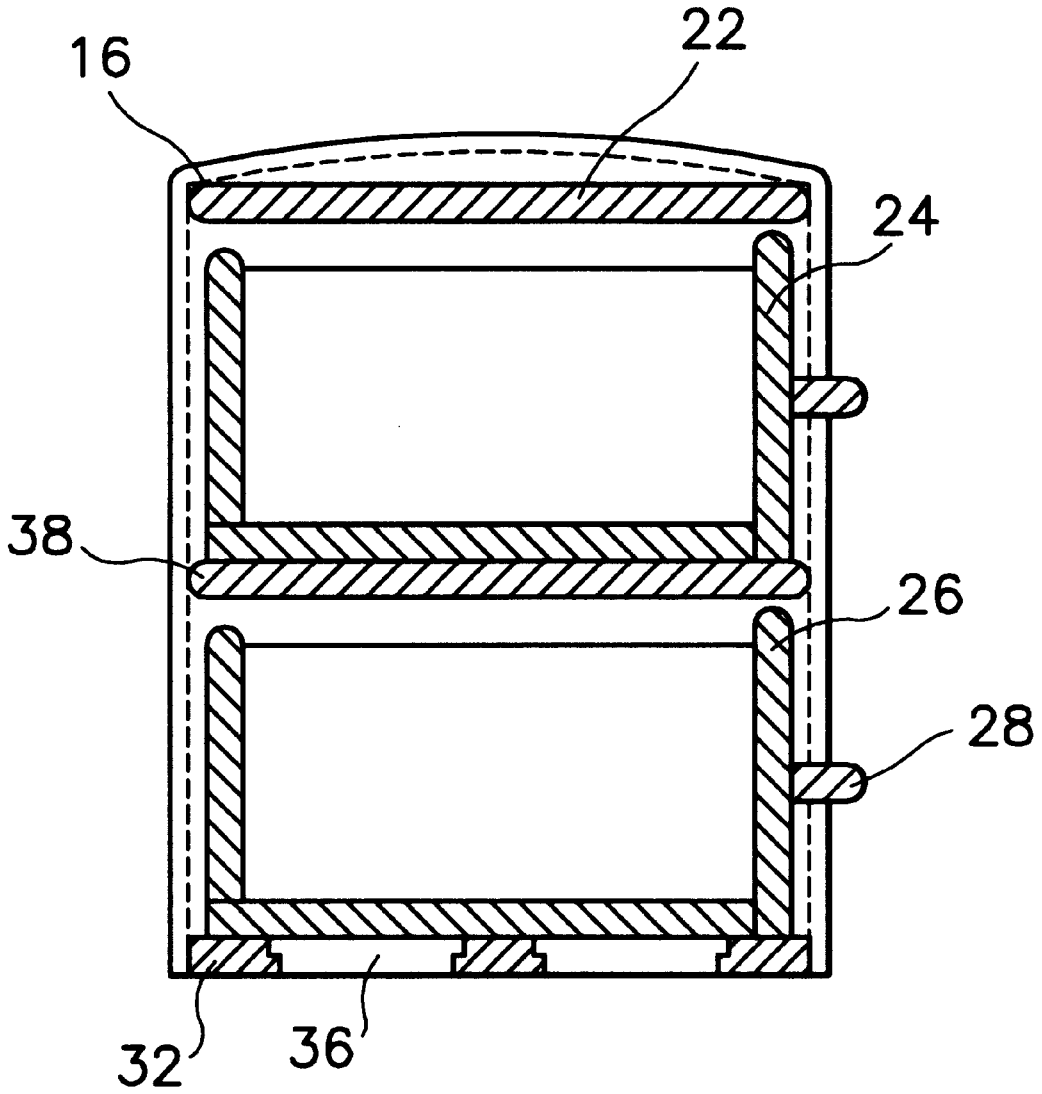
FIG. 9 illustrates a sectional left elevation view of the storage article of FIG. 1, showing a possible construction of the drawers.

I have devised a novel combination cookbook holder and recipe file for use as a kitchen storage article. This storage article has advantages over previous storage articles for use in organizing a kitchen.

The storage article according to the present invention comprises two portions. A first portion is a recipe storage portion which comprises a cardfile cabinet adapted to hold two cardfile drawers. A second portion is a cookbook holder which comprises an extendable bookrack which extends from a side of the cardfile cabinet. The construction and arrangement of the two portions of the combination storage article will now be discussed in turn, using the appended drawings as examples.

The first portion of the storage article, which portion may be used for the convenient storage of recipes as recipe cards, index cards, and newspaper or magazine clippings. This portion comprises a card file cabinet. The card file cabinet comprises a planar base member 32, having an upper face and a lower face and four edges, which base member consists of three parallel segments spaced apart from each other. The card file cabinet also comprises a first vertical side member 12 fixed to an end of the planar base member 32, and a second vertical side member 18 fixed to the base member 32 at a distance from the first side member chosen to easily accommodate the width of recipe cards. The cabinet also comprises a planar generally rectangular top horizontal member 22 a side of which is fixed to the first vertical side member 12 and an opposed side of which is fixed to the second vertical side member 18 along lines near a top edge of the vertical members. The cabinet also comprises a planar generally rectangular horizontal middle member 38, which middle member is fixed to the first and second vertical members along horizontal lines intermediate between the top member 22 and the base member 32.

The cabinet also comprises an upper and a lower drawer, disposed within the cabinet. The lower drawer is disposed upon the base member 32 and the upper drawer is disposed upon the middle horizontal member 38. These drawers may be sized to accommodate standard size index or recipe cards. The drawers may also be used for storage of recipes on clippings from publication or on other storage media, such as computer disks. Also, the upper and lower drawer each comprise a handle 28 fixed to a side of each drawer.

The base member segments each have at least one rabbeted edge arranged to permit mating with other horizontal storage unit members with similar dimensioned rabbets.

The second portion of the combination storage article is an expandable bookholder, comprising two planar horizontal members 34 slidably engaged and parallel to the base member 32 of the first portion for motion from a retracted position to an extended position, wherein the two planar horizontal members are rabbeted and their rabbets are sized and arranged to mate slidably with the rabbets of the base member segments of the first portion.

The second portion also comprises a substantially flat vertical member 14, with two opposed major faces and four edges, and which member is fixed to the horizontal members of the second portion along one edge of the vertical member. The second portion may be used to store books such as cookbooks in a vertical orientation by adjusting the distance between the second vertical member 18 of the first portion, and the vertical member 14 of the second portion, setting the distance to be approximately equal to the combined thicknesses of books to be supported. The distance is adjustable by sliding the rabbeted edges past each other in parallel motion from the retracted position to an extended position.

Figure 10:
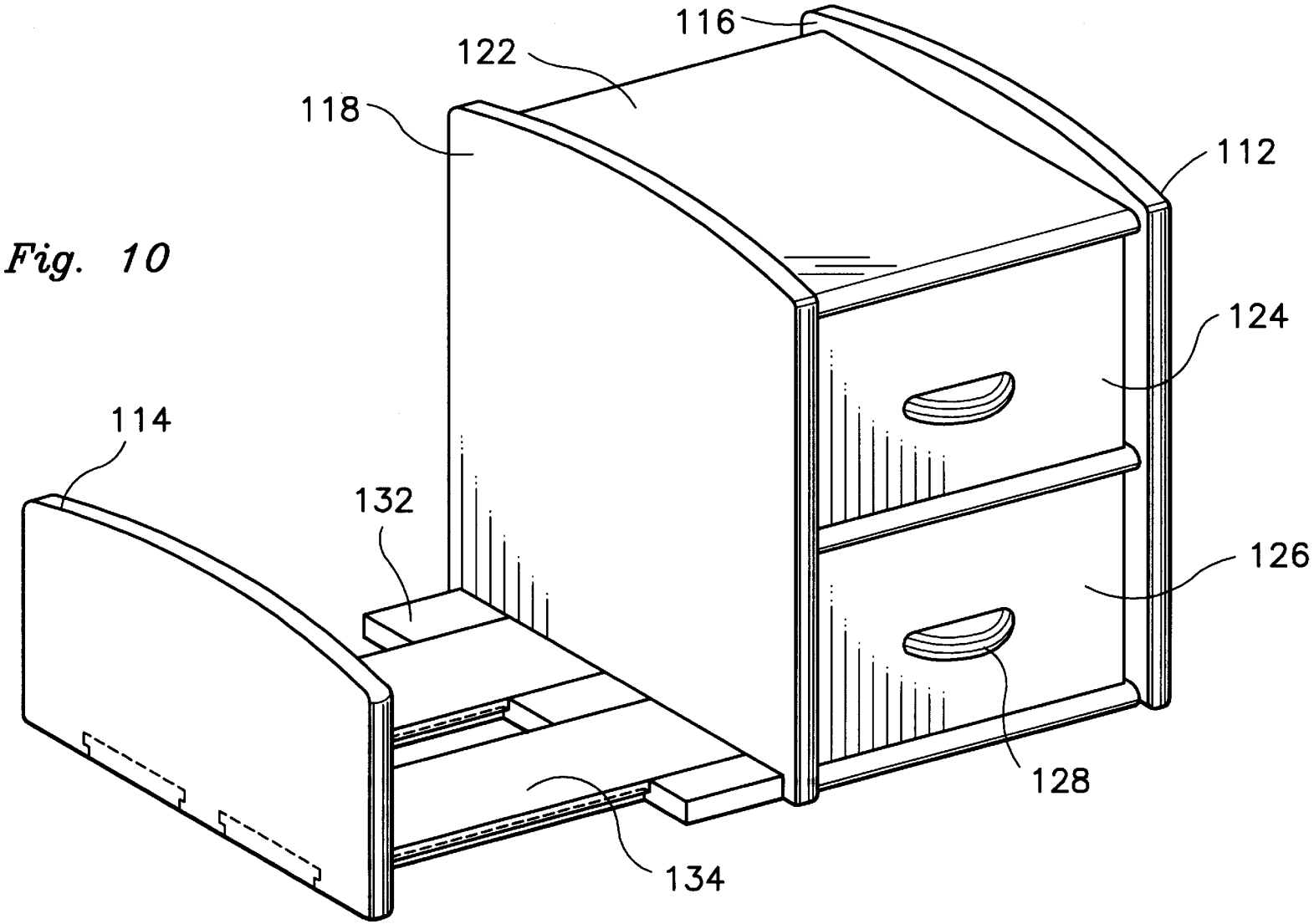
FIG. 10 illustrates a perspective view of a second embodiment of a combination storage article according to the invention, this embodiment having the drawers rearranged to change the handedness of the storage article.
Figure 11:
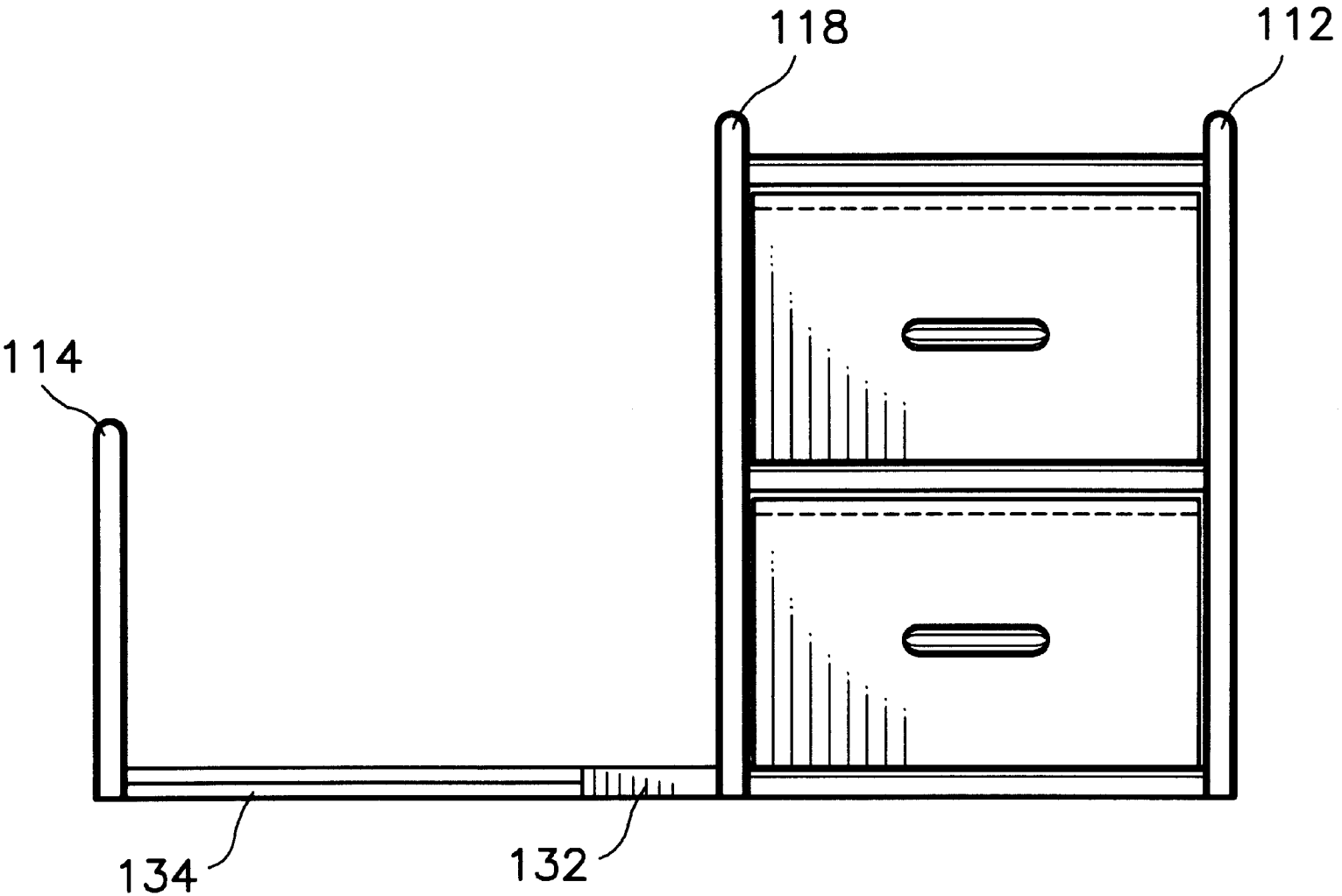
FIG. 11 illustrates a front, relative to the rearranged drawers, elevation view of the storage article of FIG. 10.
Figure 12:
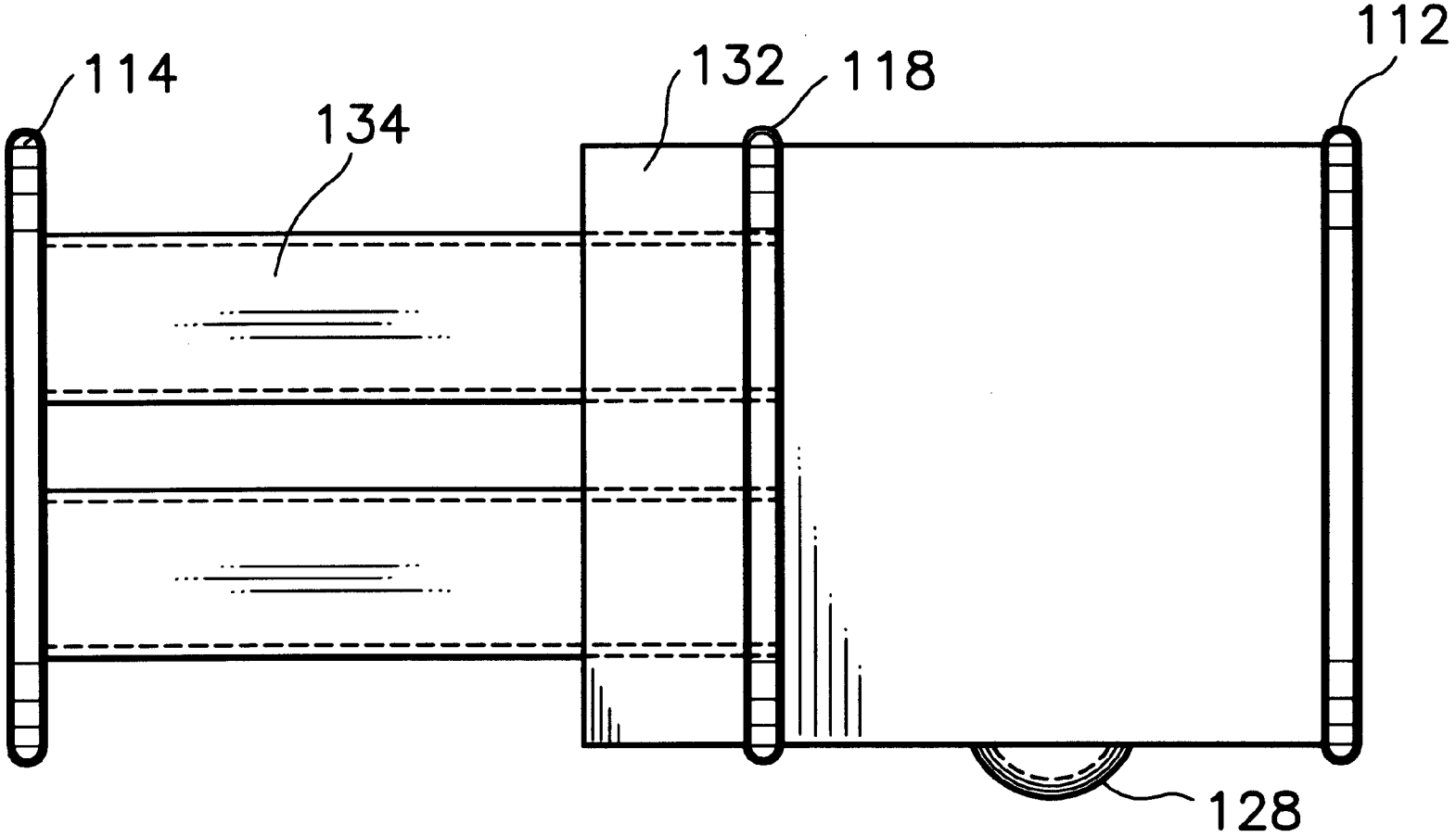
FIG. 12 illustrates a top plan view of the storage article of FIG. 10.
Figure 13:
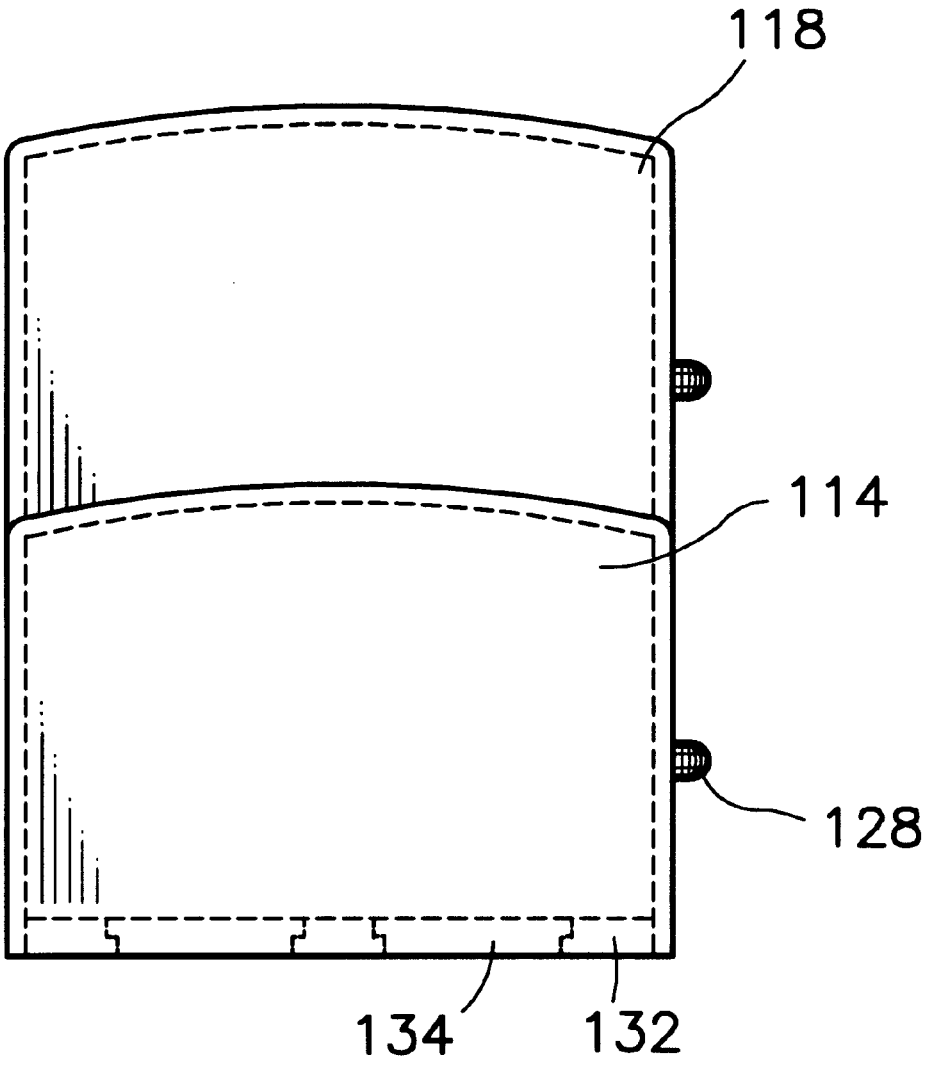
FIG. 13 illustrates a left elevation view of the storage article of FIG. 10.
Figure 14:
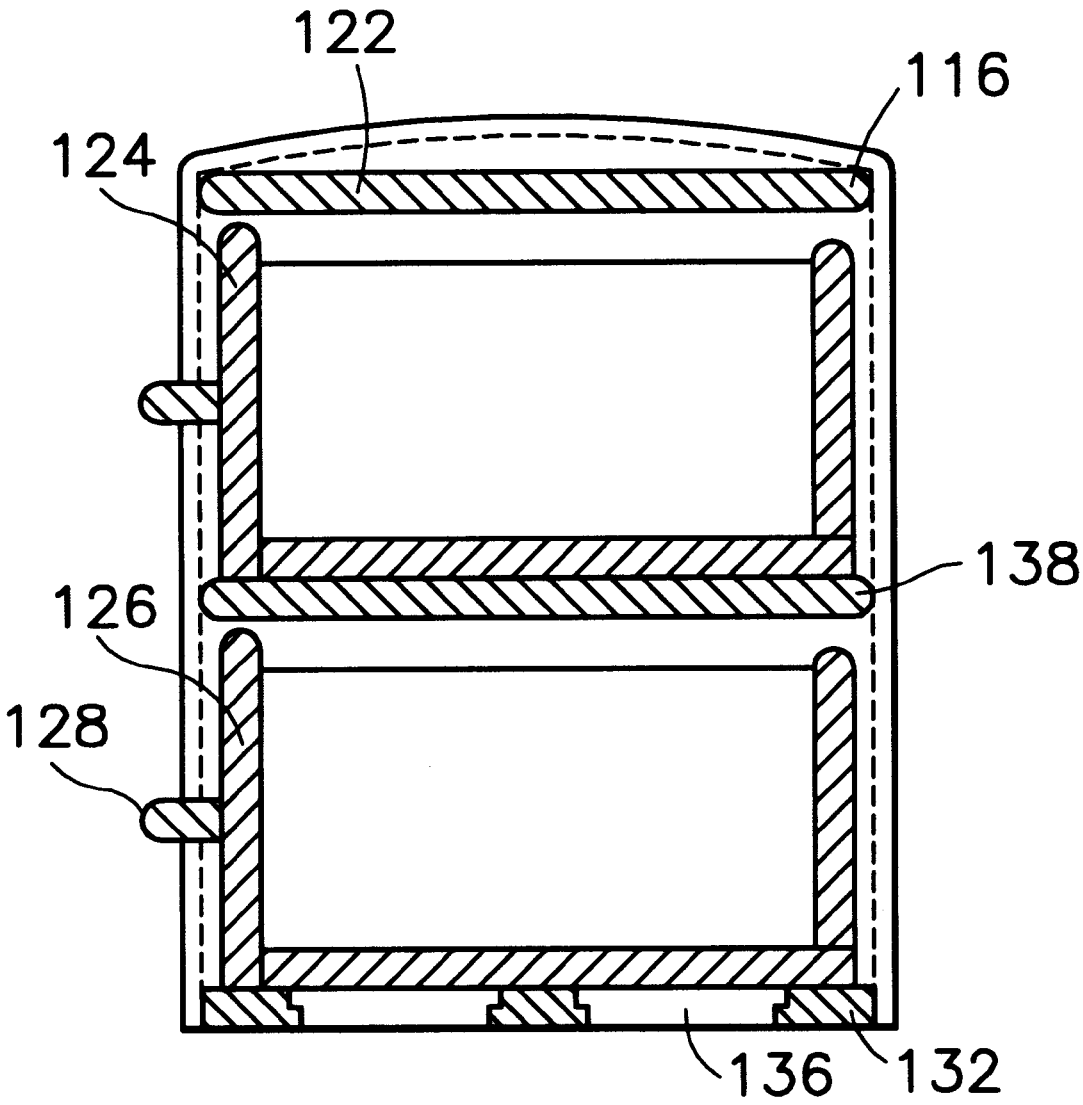
FIG. 14 illustrates a sectional right elevation view of the storage article of FIG. 10, showing the construction of the drawers.

It is a desirable feature of the storage article of the invention that the drawers may be arranged to suit the kitchen of the user or the preference of the user. The upper and lower drawers may be arranged with the handle of each drawer disposed to the front of the first portion, or to the rear thereof. The first of these arrangements is depicted in FIG. 1. The second arrangement is depicted in FIG. 10. This feature allows the user to select the orientation of the storage article which best serves the user's needs in their kitchen. It is also to be recognized that the handle of one of the drawers may be disposed to the front of the storage article while the handle of the other drawer is disposed to the back of the storage article. This latter arrangement may be selected by a user who prefers to use the storage article on an island cabinet unit in their kitchen, and who desires to have access to a drawer from each of the front and back sides of the storage article.

The storage article of the invention may be made of any suitable rigid construction material. Examples of such materials include wood, plastic laminate coated wood, plastic or metal. The preferred material of construction is wood. The method of constructing a combination storage article according to the invention would be known to one skilled in the art of woodworking.

Adjustability of the bookholding portion of the combination storage article disclosed here may be accomplished by means of dovetail joints as well as by means of the rabbeted joints illustrated in the accompanying drawings. The rabbeted joints are preferred, to simplify the construction of the storage article.

A second embodiment of the present invention could be made of course with the drawers reversed, so that the card file cabinet would be on the side opposite that shown in the accompanying drawings. That is, the mirror image combination storage article can be made by the user by removing the drawers and then replacing them after rotating them 180 degrees. The storage article according to the invention can also be used in a third embodiment, this embodiment having the handle of one drawer facing a side of the storage article and the handle of the other drawer facing the opposed side of the storage article. This would some users a more convenient arrangement when using the storage article on an island cabinet in a kitchen.

While the invention has been described herein with reference to specific and preferred embodiments, it is understood that charges, modifications, substitutions and omissions may be made without departing from the spirit and scope of the invention defined in the appended claims.

I claim:

1. A combination cookbook holder and file cabinet storage article, comprising:

a first file cabinet portion, comprising:

a planar base member, having an upper face and a lower face and four edges, wherein the base member consists of three parallel segments spaced apart from each other;

a first vertical side member fixed to an end of the planar base member;

a second side member fixed to the base member at a distance from the first side member selected to easily accomodate the width of recipe cards;

a planar generally rectangular top horizontal member having a side of which is fixed to the first vertical side member and an opposed side of which is fixed to the second vertical side member along lines near a top edge of the vertical members;

a planar generally rectangular horizontal middle member being fixed to the first and second vertical members along horizontal lines intermediate between the top member and the base member;

an upper drawer disposed within the cabinet portion and supported upon the horizontal middle member;

a lower drawer disposed within the cabinet portion and supported upon the planar base member;

wherein the upper and lower drawers each comprise a handle fixed to a side of each drawer, and wherein the base member segments each have at least one rabbeted edge arranged to permit mating with other horizontal storage unit members with similar dimensioned rabbets;

a second bookholder portion, comprising:

a substantially flat vertical member, having two opposed major faces and four edges;

two planar horizontal members generally horizontal in shape and slidably engaged with and parallel to the base member of the first portion for motion from a retracted position to an extended position;

wherein the two planar horizontal members are rabbeted and their rabbets are sized and arranged to mate slidably with the rabbets of the base member segments of the first portion; and wherein the two planar horizontal members have a first end fixed to the substantially flat vertical member of the second portion, and a second opposed end disposed between the base member segments of the first portion.

* * * * *